US006332299B1

(12) United States Patent
Stewart, III

(10) Patent No.: US 6,332,299 B1
(45) Date of Patent: Dec. 25, 2001

(54) CONNECTOR FOR MULTIPLE MEMBER FRAME SYSTEMS

(76) Inventor: Kenneth G. Stewart, III, P.O. Box 1117, Sarasota, FL (US) 34230

( * ) Notice: Subject to any disclaimer, the term of this patent is extended or adjusted under 35 U.S.C. 154(b) by 0 days.

(21) Appl. No.: 09/496,669

(22) Filed: Feb. 3, 2000

Related U.S. Application Data

(60) Provisional application No. 60/118,687, filed on Feb. 5, 1999.

(51) Int. Cl.[7] ..... E04C 3/292

(52) U.S. Cl. ..... 52/696; 52/506.05; 52/666; 52/655.1; 52/714; 52/715; 52/729.4; 52/729.5; 52/733.2; 52/737.3

(58) Field of Search ..... 52/506.05, 693, 52/696, 666, 643, 317, 713–715, 654.1, 655.1, 733.2, 729.4, 729.5, 733.3–733.4, 737.3–737.5, 281, 283; D8/349, 354, 373; 25/119, 122, 164

(56) References Cited

U.S. PATENT DOCUMENTS

| | | | | |
|---|---|---|---|---|
| D. 293,416 | * | 12/1987 | Krueger | D8/373 |
| D. 411,021 | * | 6/1999 | Chapman et al. | D25/122 |
| D. 423,325 | * | 4/2000 | Liss | D8/349 |
| 1,146,251 | | 7/1915 | Harp . | |
| 1,656,741 | | 1/1928 | Lane . | |
| 2,092,751 | | 9/1937 | Davis . | |
| 2,467,115 | | 4/1949 | Duggan . | |
| 3,010,162 | | 11/1961 | Klein . | |
| 3,831,338 | | 8/1974 | Klingensmith et al. . | |
| 4,016,700 | | 4/1977 | Blomstedt . | |
| 4,040,232 | | 8/1977 | Snow et al. . | |
| 4,068,967 | | 1/1978 | Hoodis . | |
| 4,596,101 | | 6/1986 | Brinker . | |
| 5,150,982 | | 9/1992 | Gilb . | |
| 5,390,457 | * | 2/1995 | Sjolander | 52/387 |
| 5,524,397 | | 6/1996 | Byers et al. . | |
| 5,551,200 | | 9/1996 | Krug . | |
| 5,596,859 | * | 1/1997 | Horton et al. | 52/733.3 |
| 5,606,837 | | 3/1997 | Holizlander . | |
| 5,697,725 | | 12/1997 | Ballash et al. . | |
| 5,797,694 | | 8/1998 | Breivik . | |
| 5,822,941 | | 10/1998 | Kinsella . | |
| 5,857,306 | | 1/1999 | Pellock . | |
| 5,881,520 | * | 3/1999 | Blazevic | 52/281 |
| 5,884,448 | * | 3/1999 | Pellock | 52/643 |
| 5,950,385 | * | 9/1999 | Herren | 52/481.1 |
| 6,003,274 | * | 12/1999 | Wycech | 52/232 |

* cited by examiner

*Primary Examiner*—Yvonne M. Horton

(57) ABSTRACT

A frame connector for connecting and spacing building frames is formed as a flat rigid rectangular bar with alternating depending rigid separating flaps equal in length to the desired spacing between frame members and flat rigid securement flaps equal in length to the width of a frame member and provided with holes for attaching securement devices to the frame members. A method for creating the connector is disclosed.

19 Claims, 2 Drawing Sheets

CONNECTOR FOR MULTIPLE MEMBER FRAME SYSTEMS

This application is a continuation and claims priority of U.S. Provisional Application Ser. No. 60/118,687 filed Feb. 5, 1999.

BACKGROUND AND SUMMARY OF THE INVENTION

The present invention relates to a device for connecting and spacing various members of a building frame, and particularly to a connector which secures and reinforces the various members of a wooden framed building. More particularly, the present invention relates to a galvanized steel connector to join space and reinforce studs, trusses, joists, or any frame consisting of regularly repeated building members in wooden framed buildings.

Other objects, advantages and novel features of the present invention will become apparent from the following detailed description of the invention when considered in conjunction with the accompanying drawings.

DETAILED DESCRIPTION OF THE DRAWINGS

Figure 1:
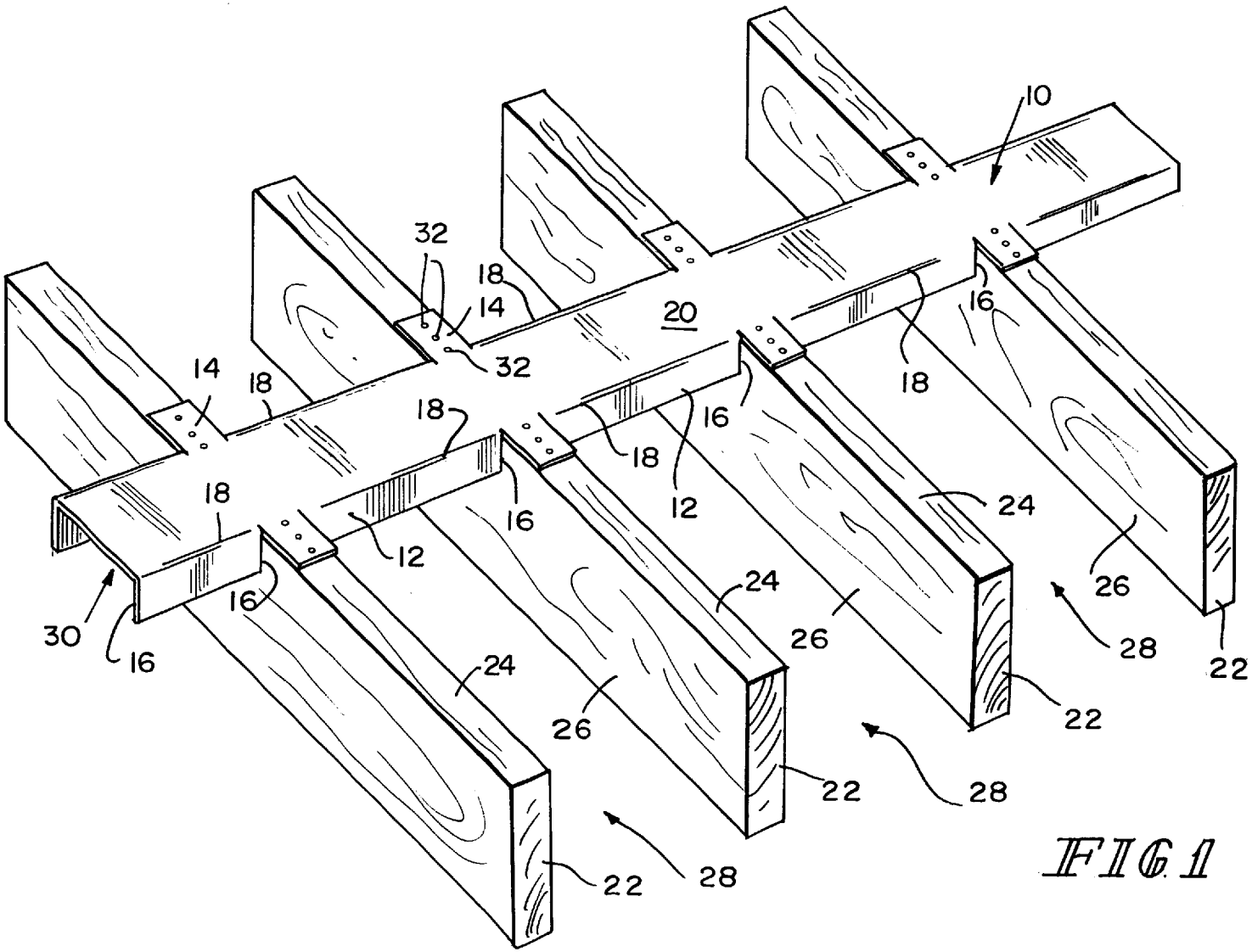
FIG. 1 is a top perspective view of a frame connector in accordance with the present invention coupled to several successive floor joists or wall studs showing the main body of the connector positioned to lie flat across the outward faces of four successive joists or studs and multiple rigidity flaps coupled to the main body of the connector and folded into the spaces between the successive joists or studs.

As shown in FIG. 1, a frame connector 10 includes a main body 20, multiple rigidity flaps 12, and multiple attachment flaps 14. The entire frame connector 10 is produced from a single sheet of material so that rigidity flaps 12 are created simply by cutting the material of frame connector 10 along multiple flap edges 16 and folding rigidity flaps 12 along multiple folds 18. In this way, rigidity flaps 12 remain directly coupled to main body 20 along folds 18, but are positioned generally perpendicular to main body 20. While rigidity flaps 12 are folded to positions generally perpendicular to main body 20, attachment flaps 14 also remain coupled to main body 20, but are positioned in generally the same plane as main body 20. Attachment flaps 14 are further formed to include multiple attachment holes 32.

Frame connector 10 is formed so that within a particular connector, rigidity flaps 12 are formed and folded in consistent lengths and are consistently spaced. In other words, within a particular frame connector, the multiple rigidity flaps will all be of the same length and will all be spaced equidistant. In this way, attachment flaps 14, which lie between rigidity flaps 12, will also necessarily be equally spaced.

Typical construction employs frame members made of common building materials such as wood and steel spaced equidistant to create a barrier of a building such as a wall, floor, ceiling, roof, etc. FIG. 1 depicts this typical construction method showing joists or studs 22 spaced equidistant with spaces 28 therebetween and having outward faces 24 and perpendicular faces 26. In operation, the builder (not shown) places the bottom face 30 of main body 20 flush against outward faces 24 of joists or studs 22. In this position, rigidity flaps 12 extend down into spaces 28 and flap edges 16 of rigidity flaps 12 abut perpendicular faces 26 of joists or studs 22. Further, attachment flaps 14 remain in generally the same plane as main body 20 and lie flat on outward faces 24 of joists or studs 22. With frame connector 10 in this position, the builder then couples frame connector 10 to joists or studs 22 by driving nails (also not shown) through attachment holes 32 and into outward faces 24 of joists or studs 22. In this position, frame connector 10 holds joists or studs 22 in perfectly equidistant relationship with each other and keeps outward faces 24 in a single plane.

It should be noted that, to one of ordinary skill in the art, it will be readily apparent that frame connectors within the scope of this disclosure can be produced for joists or studs which are not equally spaced, but which are desired to be kept in some other spacial relationship with one another, and that other methods of attachment may be used other than nails. For example, if frame connector 10 is being employed in a steel framed building, bolts, metal screws, or other suitable connectors may be positioned through attachment holes 32 to secure frame connector 10 to joists or studs 22.

Figure 2:
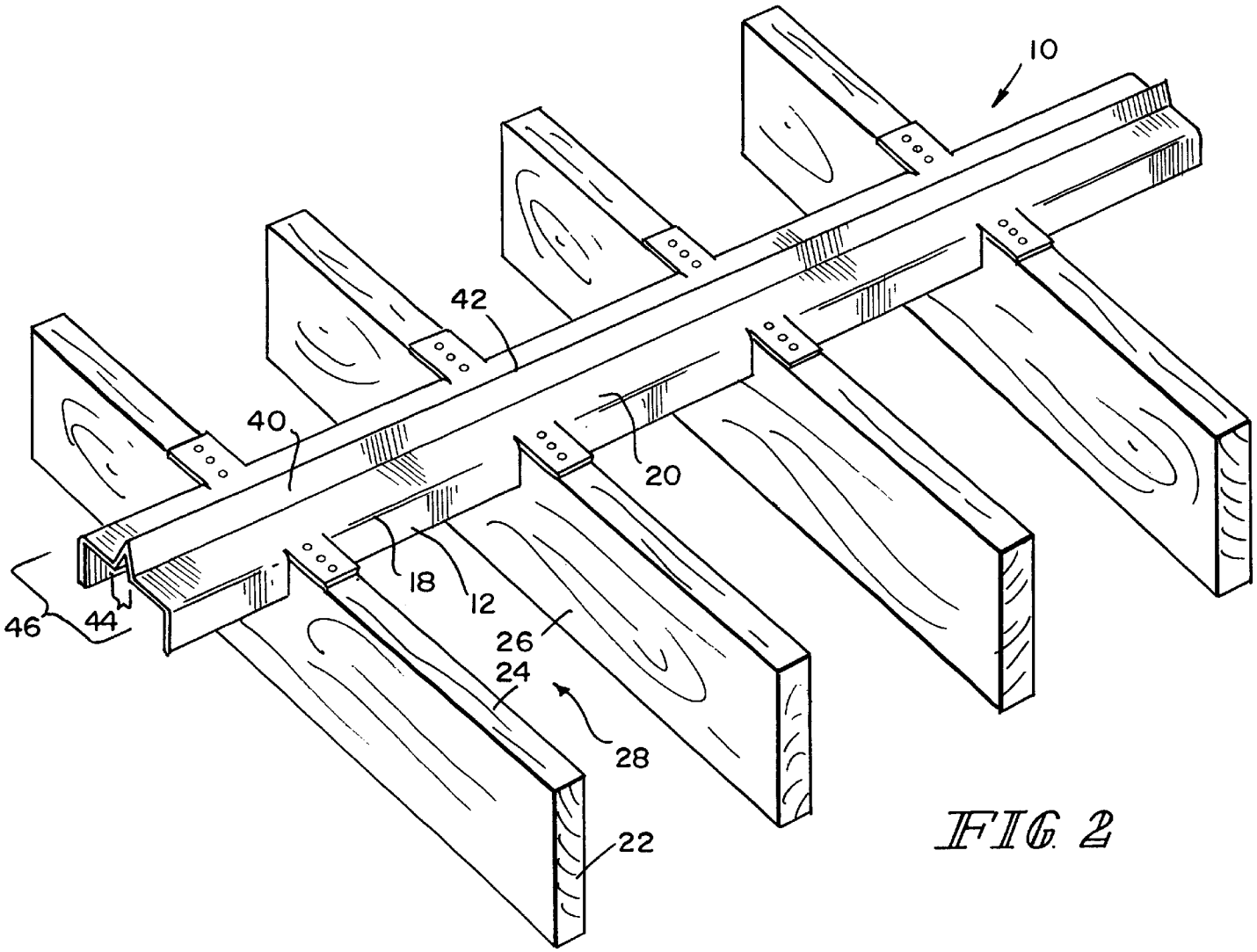
FIG. 2 is a top perspective view of an alternative embodiment of a frame connector similar to FIG. 1 with a rigidity crease formed into the main body of the connector and running the entire length of the connector.

In an alternative embodiment, shown in FIG. 2, main body 20 of frame connection 10 is formed to include a rigidity crease 40 running the length of the frame connection. Rigidity crease 40 is formed by folding a portion 44 of the entire width 46 of the main body 20 of frame connector 10 so that ridge 42 of rigidity crease 40 stands up away from the plane formed by the remainder of main body 20.

In each embodiment shown in FIGS. 1 and 2, frame connector 10 operates to secure joists or studs 22 in a precise, predetermined spacial relationship with one another. However, the embodiment shown in FIG. 2 is preferably used to secure roof trusses rather than floor joists or wall studs where rigidity crease 40 might interfere with the floor decking or drywall which covers the joists or studs. Further, main body 20 and rigidity flaps 12 of frame connector 10 operate to add rigidity in the x, y, and z axes of the building frame created by joists or studs 22.

The embodiment shown in FIG. 1 can be used to add strength and rigidity to a building frame where wall covering or floor decking is to be used over the frame connector. Main body 20 of frame connector 10 is flat. Therefore, flat floor decking or drywall may be placed directly over it, unimpeded, to allow the floor decking or drywall to sit flush against outward faces 24 of joists or studs 22.

The embodiment shown in FIG. 2 adds strength and rigidity in addition to that supplied by the embodiment of FIG. 1. However, rigidity crease 40 makes the embodiment of FIG. 2 inappropriate for locations where floor decking, drywall, or other coverings are to be used over frame connector 10.

The frame connector is made from flat rectangular stock, with cuts formed inwardly from opposing longitudinal edges to define the outline of the depending rigid flaps 12 and the bending downwardly the rigid flaps 12. The support rib 40 can be created by bending either prior to or after the bending downward of the rigid flaps 12.

While the drawings show depending flaps 12 at the end of the frame connectors, the connectors could be formed such that the ends could be located with securement flaps 14. Under either condition the number of securing flaps equals the number of frame members 24 to be connected and the number of dependent rigid flaps 12 equals one more, or one less, than the number of frame members.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A building frame connector for connecting and spacing building frame members comprising:

an elongated body having a rigid rectangular configured top portion of a length at least greater than a distance between several building frame members;

said body top portion provided with at least one pair of dependent opposed rigid flaps that extend at right angles to edges of the top portion;

said at least one pair of the rigid flaps all depending in the same direction away from the top portion;

wherein the length of the at least one pair of the rigid flaps is equal to a desired spacing between two frame members;

wherein one of the pair of at least one pair of rigid flaps is situated to depend from one long side of the rectangular top portion and the other one of the at least one of the pair of rigid flaps is situated to depend from an opposite long side of the rectangular top portion so that the two depending rigid flaps directly oppose each other in parallel relationship; and at least four attachment flaps extending from the longitudinal edges of the rigid rectangular top portion adjacent to and at right angles to the depending rigid flaps.

2. The building frame connector of claim 1, having at least two pairs of opposed rigid depending flaps and with the two pairs of rigid depending flaps separated from one another along the rigid rectangular top portion by a distance equal to the width of a building frame member.

3. The building frame connector of claim 1, wherein the attachment flaps are provided with holes for accommodating securement devices to attach the rigid rectangular top portion to a building frame member.

4. The building frame connector of claim 2, wherein the attachment flaps are provided with holes for accommodating securement devices to attach the rigid rectangular top portion to a building frame member.

5. The building frame connector of claims 1, wherein the length of each of the at least four attachment flaps taken along the rigid rectangular top portion is equal to the width of a building frame member.

6. The building frame connector of claim 2, wherein the length of each of the at least four attachment flaps taken along the rigid rectangular top portion is equal to the width of a building frame member.

7. The building frame connector of claim 3, wherein the length of each of the at least four attachment flaps taken along the rigid rectangular top portion is equal to the width of a building frame member.

8. The building frame connector of claim 4, wherein the length of each of the at least four attachment flaps taken along the rigid rectangular top portion is equal to the width of a building frame member.

9. The building frame connector of claim 1, wherein the rigid rectangular top portion is provided with a ridge extending away from the rigid rectangular top portion in a direction opposite to the directions the rigid flaps depend from the rigid rectangular top portion.

10. The building frame connector of claim 2, wherein the rigid rectangular top portion is provided with a ridge extending away from the rigid rectangular top portion in a direction opposite to the directions the rigid flaps depend from the rigid rectangular top portion.

11. The building frame connector of claim 3, wherein the rigid rectangular top portion is provided with a ridge extending away from the rigid rectangular top portion in a direction opposite to the directions the rigid flaps depend from the rigid rectangular top portion.

12. The building frame connector of claim 4, wherein the rigid rectangular top portion is provided with a ridge extending away from the rigid rectangular top portion in a direction opposite to the directions the rigid flaps depend from the rigid rectangular top portion.

13. The building frame connector of claim 5, wherein the rigid rectangular top portion is provided with a ridge extending away from the rigid rectangular top portion in a direction opposite to the directions the rigid flaps depend from the rigid rectangular top portion.

14. The building frame connector of claim 6, wherein the rigid rectangular top portion is provided with a ridge extending away from the rigid rectangular top portion in a direction opposite to the directions the rigid flaps depend from the rigid rectangular top portion.

15. The building frame connector of claim 7, wherein the rigid rectangular top portion is provided with a ridge extending away from the rigid rectangular top portion in a direction opposite to the directions the rigid flaps depend from the rigid rectangular top portion.

16. The building frame connector of claim 8, wherein the rigid rectangular top portion is provided with a ridge extending away from the rigid rectangular top portion in a direction opposite to the directions the rigid flaps depend from the rigid rectangular top portion.

17. The method of making a building frame connector for connecting and spacing building frame members comprising:

obtaining a rectangular flat sheet of rigid material;

cutting the length of the material to a distance at least equal to the combined thickness of at least two building frame members to be connected and secured in addition to a desired distance between the two members;

making a plurality of opposing inwardly extending cuts from both longitudinal edges of the flat sheet toward the center of the flat sheet leaving an uncut center portion;

the inwardly extending cuts being in opposing pairs from each longitudinal edge of the flat sheet and spaced along each of the longitudinal edges to produce opposing adjoining flaps therebetween which have a length along each longitudinal edge equal to a distance of a width of a frame member and a desired spacing between frame members and bending downward the flap material between a first and second cut along the longitudinal edge to form a rectangular depending rigid flap for spacing two adjoining building frame members.

18. The method of claim 17, wherein the number of inwardly extending cuts is coordinated with the number of building frame members to be joined and spaced such that the number of depending rigid flaps provided for is equal to at least one of one less than the number of frame members to be joined and one more than the number of frame members to be joined.

19. The method of claim 17, wherein a raised supporting rib is formed along the longitudinal axis of the rectangular flat sheet by folding upwardly a v-shape trough in the middle of the rectangular flat sheet.

* * * * *